US005271160A

United States Patent [19]

Greiner et al.

[11] Patent Number: 5,271,160

[45] Date of Patent: Dec. 21, 1993

[54] HAIR DRYER ATTACHMENT FOR DRYING LONGER HAIR

[75] Inventors: Caryl J. Greiner, North Branch; Richard A. Maitrejean, Hinckley, both of Minn.

[73] Assignee: Carylco, Inc., North Branch, Minn.

[21] Appl. No.: 949,439

[22] Filed: Sep. 23, 1992

[51] Int. Cl.[5] ..... A45D 20/00

[52] U.S. Cl. ..... 34/3; 34/99; 34/97

[58] Field of Search ..... 34/96, 97, 98, 99, 3, 34/91, 100, 101, 90

[56] References Cited

U.S. PATENT DOCUMENTS

| | | | |
|---|---|---|---|
| 389,803 | 9/1888 | Godefroy | 34/99 |
| 1,907,215 | 5/1933 | Pfahl | 34/99 |
| 2,205,972 | 6/1940 | Davis | 34/99 |
| 2,496,597 | 2/1950 | Newman | 34/99 |
| 3,782,002 | 1/1974 | Morane | 34/99 |
| 3,818,600 | 6/1974 | Fischer | 34/99 |
| 3,822,483 | 7/1974 | Hubner | 34/99 |
| 3,829,984 | 8/1974 | Hubner | 34/99 |

*Primary Examiner*—Henry A. Bennet
*Assistant Examiner*—Denise L. Gromada
*Attorney, Agent, or Firm*—Stroud, Stroud, Willink, Thompson & Howard

[57] ABSTRACT

An attachment for a dome-shaped warm air hair dryer, especially for drying long hair. The attachment includes a circular manifold which receives air from the hair dryer. The manifold is coupled to a series of chambers which define a trailing drape. The chambers have orifices which divert warm air around the hair which is to be dried. A pad means is disposed around the perimeter of the drape to contain the hair and to permit drying air to flow therearound.

2 Claims, 7 Drawing Sheets

HAIR DRYER ATTACHMENT FOR DRYING LONGER HAIR

This invention relates to hair dryers. In particular this invention relates to dome-shaped hair dryers, especially those found in professional hair salons. Yet more particularly, this invention relates to attachments to such hair dryers which are to assist the drying of longer hair.

BACKGROUND OF THE INVENTION

The drying of hair after a color change, permanent or a shampoo in a professional hair salons is generally accomplished by the well-known dome-shaped, warm air dryer. Such dryers are placed over the head of the customer, the dome encircling the top and sides of the customer's head. Warm air is generated and forced out exit holes within the dome, impinging upon the customer's wet hair. In this manner, the hair is efficiently dried.

Dome-shaped commercial hair dryers have not been found to work well for customers having hair extending below about the nape of the neck. Warm air orifices in the dome of the hair dryer, only tend to dry hair located on the top of the head. However hair extending below the dome is not normally reached by these air streams. Thus, the customer's hair is only partially dried.

The present invention overcomes the problem of prior art commercial hair dryers in that it provides a means by which hair on the top of the customer's head and hair extending below the nape of the neck can be contemporaneously dried. This invention, which is an attachment to a warm air hair dryer, permits efficient, comfortable drying of hair, extending down the back of the head.

DESCRIPTION OF THE PRIOR ART

U.S. Pat. No. 4,118,874 to Morane describes a hair dryer, especially for long hair. The hair dryer of Morane (as opposed to the present hair dryer attachment) is an elongate tubular structure having inner and outer ducts connected, at one end to a centrifugal fan, and at the other end, to a hood. The fan, which is located behind and below the user, draws in air through the inner duct and forces it outward through the outer duct. The inner duct, having a grille therein, supports the user's long hair during the drying process.

U.S. Pat. No. 3,822,483 discloses a portable hair dryer for long hair. The '483 invention patent discloses a freely portable hair dryer hood or cap which having inner and outer jackets which merge into a double walled hose. The double walled hose is open at the bottom while and is interconnected at its lower rim. Thereof the hood above the neck is safely sealed in the vicinity of the facial lone by means of a hood rim which extends below the neckline. The invention of the '483 patent is intended for attachment to a portable hair dryer.

U.S. Pat. No. 3,717,936 to Tolmie et al discloses rigid hoods used in conjunction with a portable hair dryer. A rigid structure having a generally verticle duct which directs the air up the duct to a lower rung of vent holes located just above neck level. Tolmie does not recognize any issue relating to the drying of long hair.

U.S. Pat. No. 3,782,002 discloses an accordion-pleated duct connected to the opening of a hair dryer in which the user's head is placed. The hair is drawn inwardly and is dried by air flowing outwardly near the periphery of the duct.

None of the above patents, alone or in combination, disclose or suggest the present invention.

BRIEF SUMMARY OF THE INVENTION

Briefly, in one aspect, the present invention is an attachment for a dome-shaped warm air hair dryer. Such dome-shaped hair dryers open downward and permit a user to place their head within the dome-shaped housing to dry their hair. The attachment of the present invention includes a flexible, tubular, substantially circular manifold, this manifold being adapted to receive warm air radially directed from the base of the hair dryer. As is set forth in more detail below, the present invention includes a method of adapting or modifying a commercial hair dryer so as to create a radially-directed air stream usable in conjunction with the present invention to dry long hair.

The present hair dryer attachment further includes a plurality of chambers, the chambers being in air or fluid communication with the manifold and projecting downwardly therefrom. The chambers receive warm air collected by the manifold and, in operation, conduct the warm air over the nap of the users neck toward the user's posterior side. Preferably speaking, the chambers are vertically elongated, and parallel to each other. They at least partially define a drape, shroud or elongate collar which hangs down the back of the user. The drape includes a perimeter-disposed pad means which gives three dimensional depth to the pad. The pad permits the user to lean backward, e.g., against the main part of a hair dryer, without crimping or compressing the channels and reducing air flow to the hair and compressing the wet hair. Generally a "U" shaped pad has been found to work best.

Lastly, the chambers include a plurality of output orifices located so that air passing therethrough is directed toward the posterior side of the user so as to dry the user's hair hanging or laying thereon.

The present hair dryer attachment is flexible and is attached or appended to the opening of a commercial dome-shaped hair dryer by, for example, a Velcro fastener. Utilization of the present invention permits the efficient, comfortable drying of longer hair without compressing it.

BRIEF DESCRIPTION OF THE DRAWINGS

The present invention may be better understood by reference to the detailed description below and the attached figures in which like numerals are used to refer to like features and in which.

DETAILED DESCRIPTION OF THE INVENTION

Figure 1:
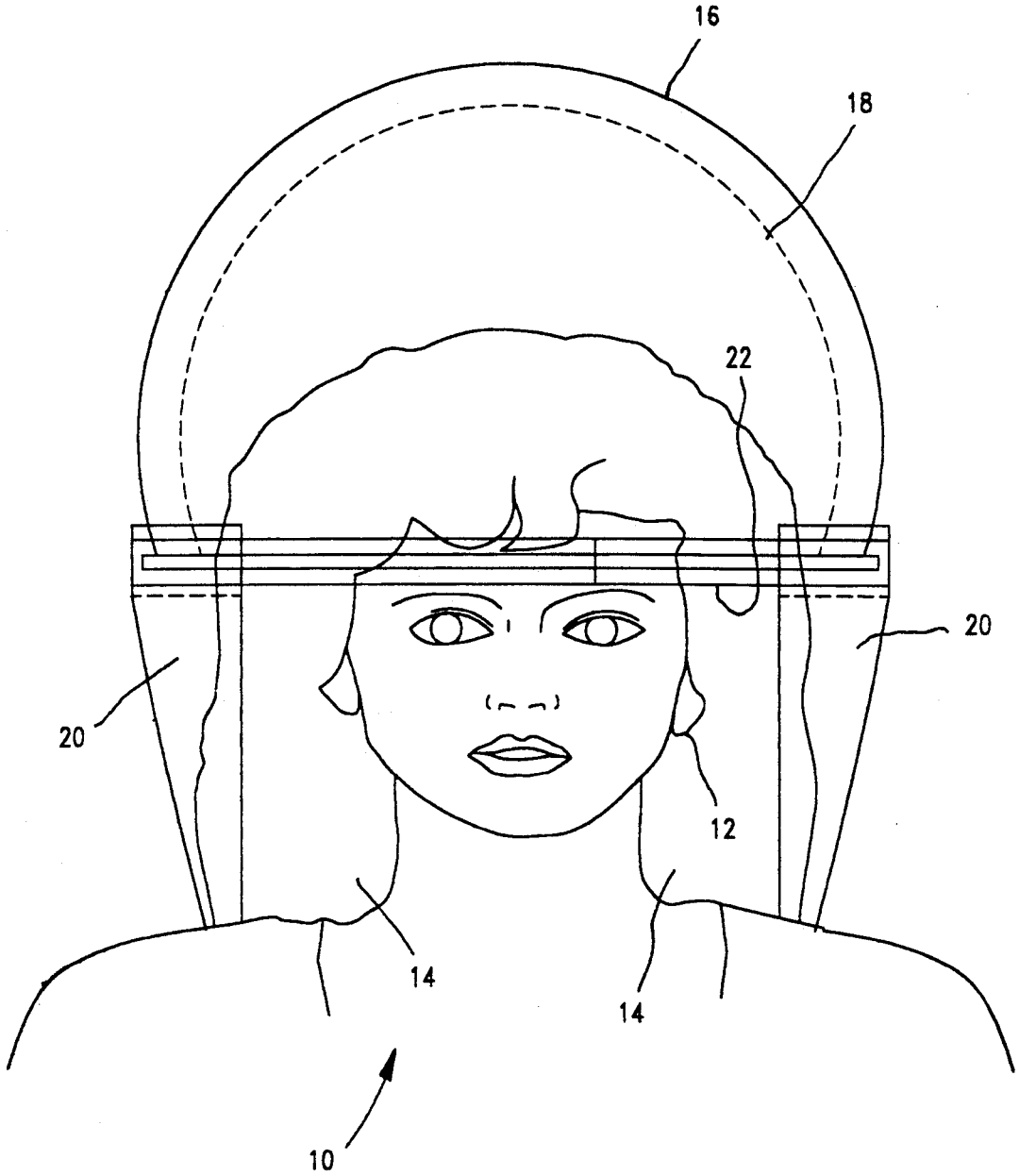
FIG. 1 is a perspective frontal view of a hair dryer using an attachment of the present invention.

Thus there is shown in FIG. 1 a front view of a user 10 of the present invention. A user 10 of the present invention would have long hair which would generally extend downward below the user's ears 12. As shown, a dome-shaped commercial hair dryer 16 provides the warm air which is deployed around the user's hair in a practice of the present invention. Hair dryer 16 includes an interior concave shell 18 (shown in phantom in FIG. 1) which directs warm air around the user's head, thereby drying hair on the top of the user's head. An attachment 20 of the present invention is connected or coupled in a manner to be more completely described below about or around the opening or base 22 of hair dryer 16.

Figure 2:
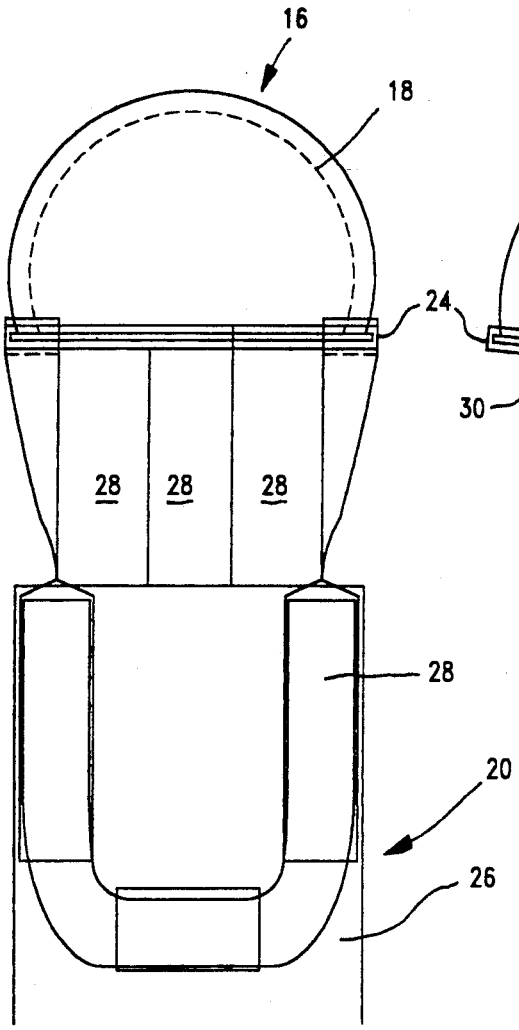
FIG. 2 is a front view the invention shown in FIG. 1 with the user being deleted.
Figure 3:
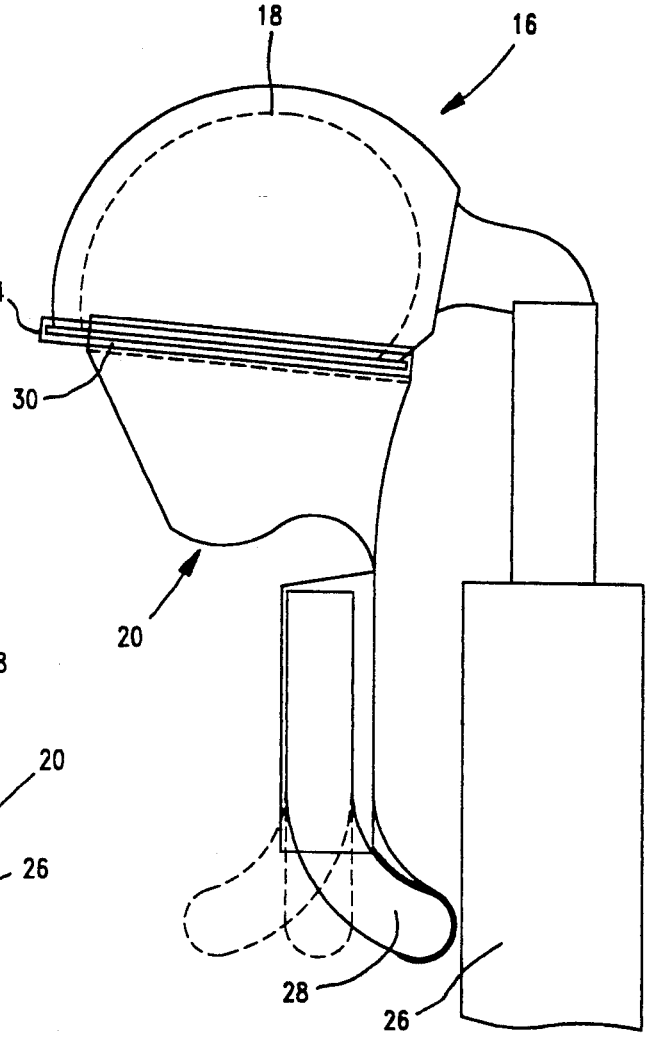
FIG. 3 is a side view of the apparatus shown FIG. 2.

FIGS. 2 and 3 show the details of the interaction between an attachment 20 of the present invention and a standard hair dryer 16. As shown in FIGS. 2 and 3, attachment 20 includes a manifold 24 which is retained about the opening or base of hair dryer 16. Manifold 24 receives warm air generated by, for example warm air source 26 which is distributed around the interior of commercial hair dryer 16 by interior shell 18, interior shell or warm air distribution member 18 being shown in phantom in both FIGS. 2 and 3.

Coupled to manifold 24 are a plurality of chambers 28 which receive warm air therefrom. Chambers 28 are air or fluidically coupled to manifold 24 along its bottom 30 so as to direct warm air received therefrom downwardly. In this manner, warm air generated by hair dryer 16 is directed behind and posteriorly the user.

Figure 4:
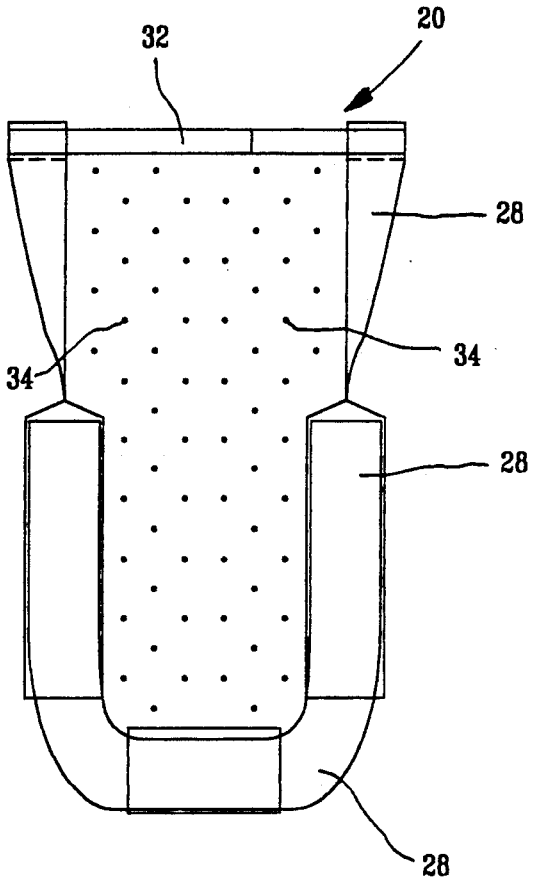
FIG. 4 is a frontal view of an attachment of the present invention showing its detailed internal construction.
Figure 5:
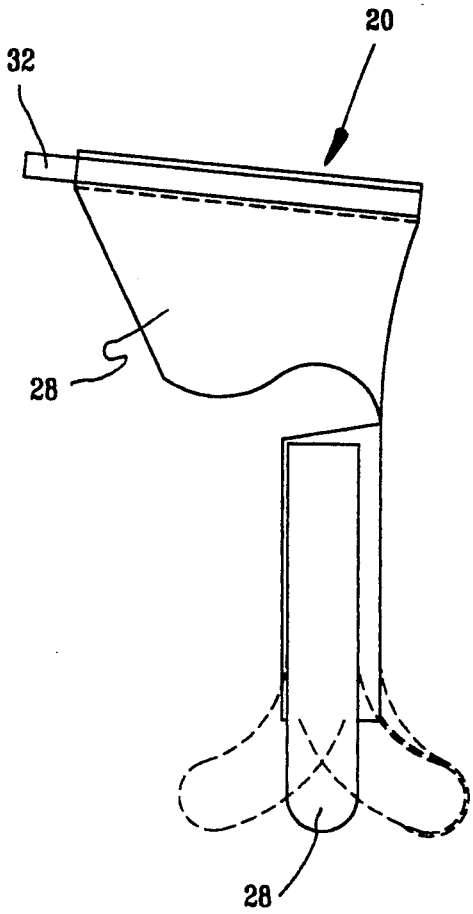
FIG. 5 is side view of the attachment shown in FIG. 4.

FIGS. 4 and 5 show an attachment 20 of the present invention after removal from a hair dryer. Attachment 20 includes attachment means 32 which is used to retain attachment 20 around the opening or bottom of a dome-shaped hair dryer. A preferred attachment means is generally a strap or band which usually employs, for example, a Velcro fastener (not shown).

Within the plurality of chambers 28 is a plurality of openings 34 from which warmed air can exit. Warmed air exiting from openings 34 would impinge upon the long hair of the user and thereby dry it. FIGS. 4 and 5 show a "U" shaped, cylindrical pad retained within hollow, peripheral (i.e., around the perimeter or edge of the trailing shroud) sleeves 62. As is best seen in FIG. 5, pad 60 may be substantially planar or it may be dorsally or anteriorly (shown in phantom) disposed at its lower extremity. Other shapes could be used. Pad 60 and sleeves 62 give a three dimensional depth to the attachment to contain the user's hair so that it is quickly and efficiently dried.

Figure 6:
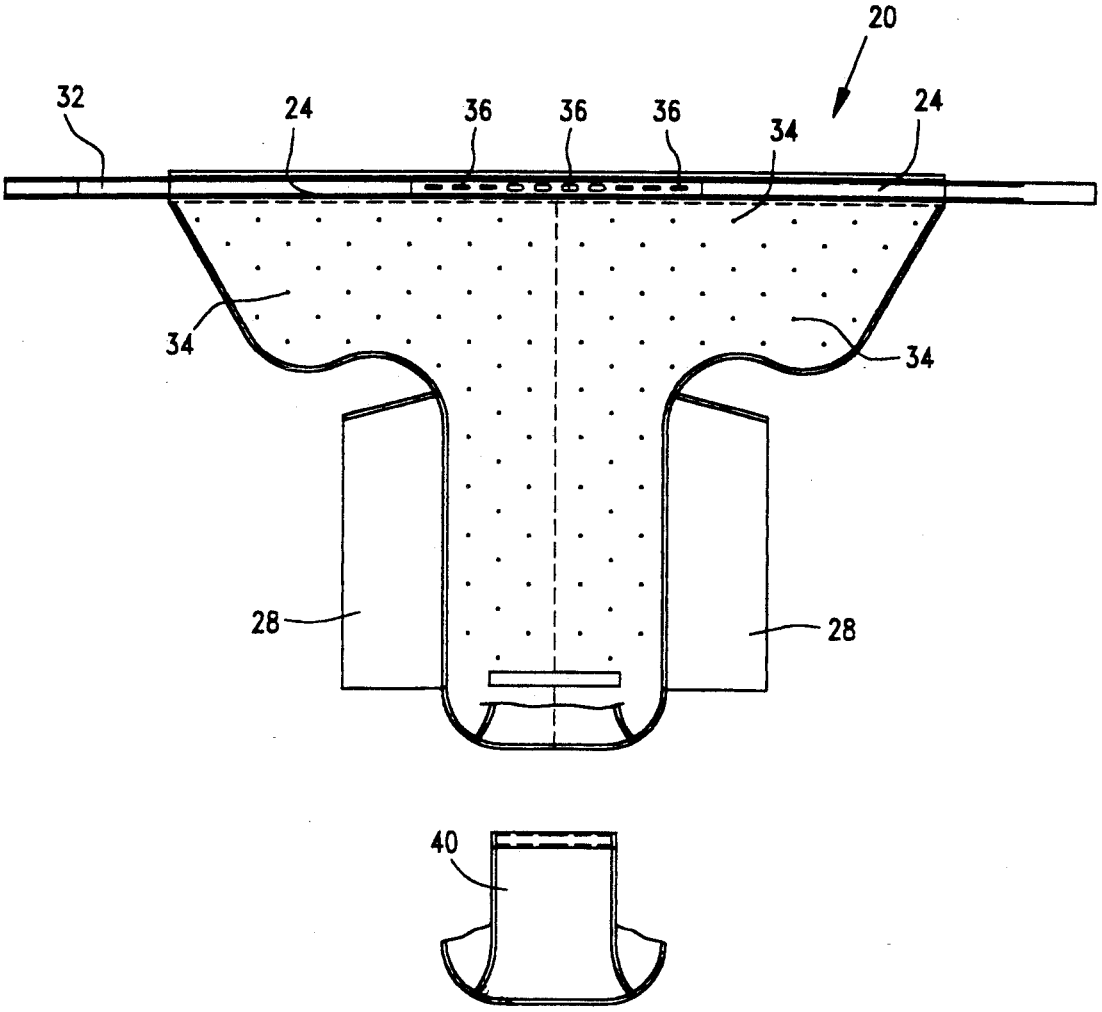
FIG. 6 is an exploded view of an attachment of the present invention showing the details of its internal construction.

FIG. 6 illustrates the structural details of attachment 20. Manifold 24 has a plurality of air inlet ports 36 which, in operation, receive air from the warmed air dryer. Warmed air input to manifold 24 by inlet ports 26 passes through chamber 28 and out exit openings 34. Band 32 would be wrapped around the base e.g. by means of a lip, of a commercial hair dryer.

Figure 7:
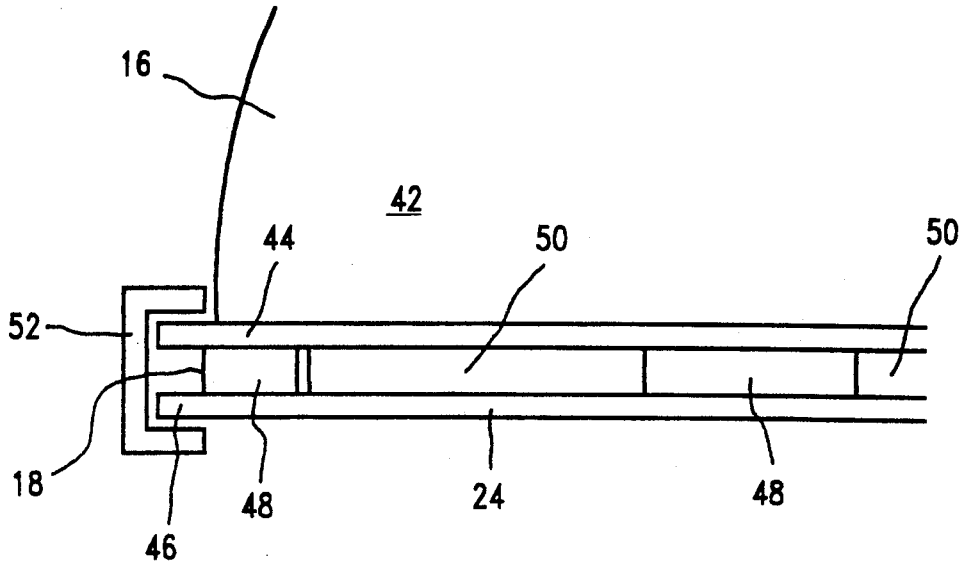
FIG. 7 is a detail of an attachment of the present invention showing the details of its attachment to a domed hair dryer.

FIG. 7 shows, in section, the details of the interaction between a commercial hair dryer and the manifold 24 of the present attachment.

Hair dryers with which the present invention can be used include an exterior, usually metal, cover 42 and an interior shell or insert 18 which is generally of a lesser radius than metal cover 42. Cover 42 includes an exterior lip 44 which cooperates with an analogous lip 46 on interior shell 18. Separating lips 44, 46 are optional spacers 48. Spacers 48 tend to retain interior shell 46 slightly inward from cover 42 thereby defining an air gap 50 from which warmed air emits when the dryer is run. The emitted warmed air is collected by manifold 24 (not shown) and directed into the present hair dryer attachment. Attachment 20 is held in place (by means of its manifold) to receive radially directed air from air gap 50 by means of band, e.g. a Velcro band 52. It is this modification of the presently-known commercial hair dryers which permit the present invention to be inexpensively and easily connected to essentially any dome-shaped hair dryer.

Figure 8:
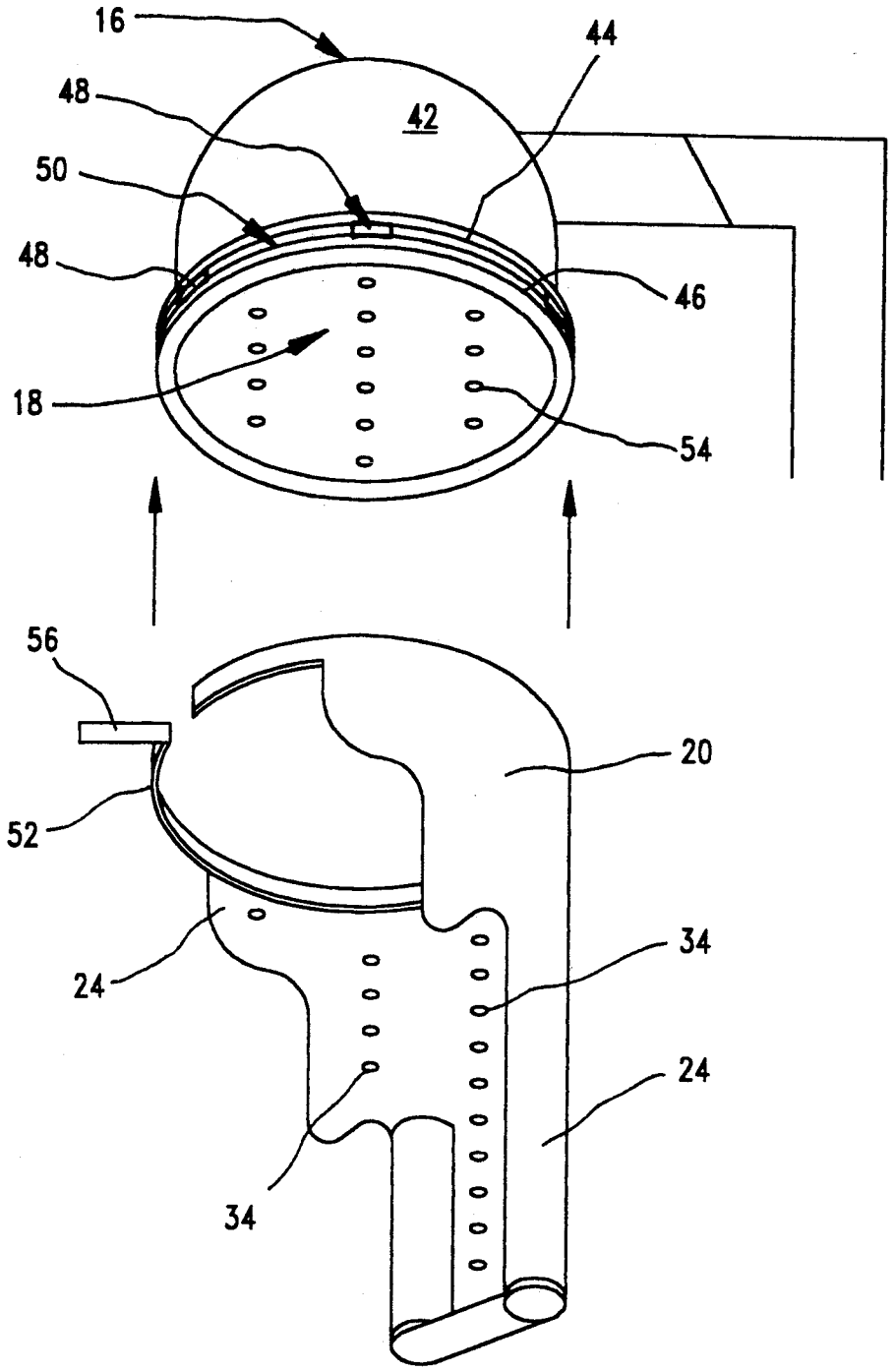
FIG. 8 is an exploded assembly view showing connection of the attachment to a dryer.

FIG. 8 shows the manner in which attachment 20 of the present invention is connected to a dome-shaped commercial hair dryer 16. Commercial hair dryer 16 includes an exterior shell 42 or cover and an interior shell 18 having holes therein. Interior shell 18 is removed from external cover 42 and optional spacers 48 inserted between the lips 44, 46 thereof. Inserts 48 are optional since gravitational force would dispose the inner shell below cover 42. Inserts or spacers 48 create an air-gap 50 between dome-shaped cover and insert 18 thus permitting air emerging from the interior of hair dryer 16 to be radially directed into manifold 24 of attachment 20. Band 52 and Velcro fastener 56 connect attachment 20 to hair dryer 16 to complete the assembly. Lastly, warm air generated by the commercial hair dryer emerges from the dome of the dryer through holes 54 and dries hair on the top of the users head. Other warmed air emerges from air gap 50 into the manifold 24 of the present invention, traverses chambers 28 and emerges from exit openings 34 to dry the users long hair extending down the back of his/her neck. In this manner rapid economical drying of the hair is obtained.

Figure 9:
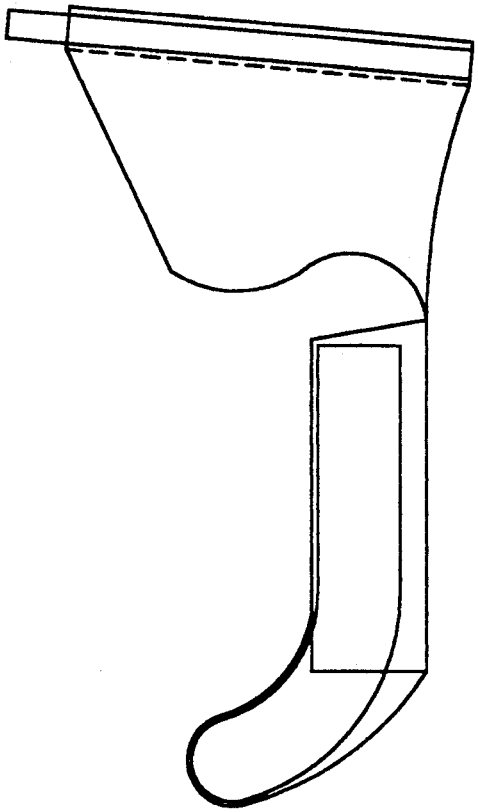
FIG. 9 is a detail of an embodiment providing a cylindrical pad on the present invention.

FIG. 9 illustrates an embodiment of the invention in which cylindrical pad 60 is disposed toward the back side of the user of this device. This embodiment provides a particularly comfortable back support to the user.

Numerous characteristics and advantages of the invention covered by this document have been set forth in the foregoing description. It will be understood, however, that this disclosure is in many respects only illustrative. Changes made in details, particularly in matters of shape, size, and arrangement of parts without exceeding the scope of the invention. The invention's scope is defined in the language in which the independent claims are expressed.

What is claimed is as follows:

1. An attachment for a dome-shaped warm air hair dryer for drying hair extending down the back of the neck, the attachment comprising:

a flexible tubular, substantially circular manifold, said manifold being adapted to receive warm air radially directed from a hair dryer, and further including means for attachment to a hair dryer, the manifold being in communication with:

a plurality of chambers, the chambers defining a trailing drape having a perimeter and being disposed below said manifold to receive air therefrom and to direct the air downward from the manifold, over hair which is to be dried, the chambers having therein:

a plurality of output orifices, the orifices being located in the chambers so as to direct warm air toward hair which is to be dried located on the back of the neck, the attachment further including:

pad means located around the perimeter of the drape so as to contain hair extending therewithin.

2. A method of modifying a dome-shaped warm air hair dryer comprising an outer cover having a circular lip and an inner shell also having a circular lip, the cover and the shell cooperating at their respective lips to define the hair dryer opening, the method comprising the steps of:

separating the cover and the shell, placing a spacer between the lips of the cover and the shell to provide a radial space from which air can exit the hair dryer; and attaching an attachment so as to collect warm air radiating from between the shell and the spacer, the attachment comprising a flexible tubular, substantially circular manifold, said manifold being adapted to receive warm air radially directed from the hair dryer, the manifold being in communication with:

a plurality of chambers, the chambers defining a trailing drape having a perimeter and being disposed below said manifold to receive air therefrom and to direct the air downward from the manifold, over hair which is to be dried, the chambers having therein:

a plurality of output orifices, the orifices being located in the chambers so as to direct warm air toward hair which is to be dried located the back of the neck, the attachment further including:

pad means located around the perimeter of the drape so as to contain hair extending therewithin whereby warm air radiating from between the shell and the cover is collected.

* * * * *